United States Patent [19]

Se

[11] 4,223,044

[45] Sep. 16, 1980

[54] METHOD FOR BREAKING A BRIDGE OF PARTICULATE AND GROUND SUBSTANCES

[75] Inventor: Tsuneyuki Se, Fukuoka, Japan

[73] Assignees: Marubeni Corporation, Higashi; Japan Fumigation Development Co., Ltd., Osaka, both of Japan

[21] Appl. No.: 907,775

[22] Filed: May 19, 1978

[30] Foreign Application Priority Data

Jul. 26, 1977 [JP] Japan ..... 52-90077
Dec. 9, 1977 [JP] Japan ..... 52-148393

[51] Int. Cl.[3] ..... A01F 25/20; B65D 88/70

[52] U.S. Cl. ..... 426/318; 52/197; 99/646 S; 99/472; 99/467; 134/22 R; 222/195; 366/101; 366/106; 406/136; 422/32; 422/33; 422/37; 426/419

[58] Field of Search ..... 426/418, 419, 404, 320, 426/312, 313, 314, 316, 318, 319; 99/646 S, 472, 473, 467; 422/32, 33, 37; 134/22 C, 24, 8, 22 R; 52/197; 222/195; 366/101, 106

[56] References Cited

U.S. PATENT DOCUMENTS

| | | | |
|---|---|---|---|
| 3,206,275 | 9/1965 | Sair | 426/312 X |
| 3,215,560 | 11/1965 | Kredit | 134/22 C |
| 3,288,537 | 11/1966 | Hitch | 302/53 |
| 3,396,762 | 8/1968 | Paton | 426/419 |
| 3,427,952 | 2/1969 | Moon et al. | 99/472 |
| 3,725,081 | 4/1973 | Barham | 426/318 |
| 3,756,475 | 9/1973 | Emery | 366/101 X |
| 3,802,333 | 4/1974 | Perez et al. | 99/472 |
| 3,861,753 | 1/1975 | Lesk et al. | 222/195 X |
| 3,933,280 | 1/1976 | Plumb | 222/195 X |
| 3,987,209 | 10/1976 | Andre et al. | 426/398 X |
| 4,059,311 | 11/1977 | Spitzer et al. | 222/195 X |

FOREIGN PATENT DOCUMENTS

| | | | |
|---|---|---|---|
| 203661 | 3/1924 | United Kingdom | 426/419 |
| 820987 | 9/1959 | United Kingdom | 426/419 |

*Primary Examiner*—Steven L. Weinstein
*Attorney, Agent, or Firm*—Frishauf, Holtz, Goodman & Woodward

[57] ABSTRACT

A bridge of particulate and ground food, feed and inorganic substances, such as soybean meal, corn meal, flour, cement and the like in a storage vessel is broken by reducing the internal pressure of the vessel and introducing inert gas under pressure of from atmosphere to up to 10 kg/cm$^2$ to impart impact for breaking the bridge of the particulate and ground substances. After discharge of the particulate and ground substances from the storage vessel, the matter sticking to the internal walls of the vessel can be removed by again reducing pressure and giving impact of introduced atmosphere or pressurized gas. Further, the internal pressure of the closed storage vessel is reduced prior to injecting fumigant gas and thereafter by introducing inert gas the internal pressure is brought to normal pressure to improve fumigation of the substances.

13 Claims, 3 Drawing Figures

6
7
2
a
f
b
i
1
5
18
17
g
c
j
19
11
12
10
16
h
d
k
3
20
24
23
5'
e
9
9
13
15
14
4
8

RELATION BETWEEN DEGREE OF REDUCED PRESSURE IN A STORAGE VESSEL AND MAXIMUM BREAKING PRESSURE INTRODUCED BELOW A BRIDGE, WHICH IS REQUIRED FOR BREAKING OF A BRIDGE

METHOD FOR BREAKING A BRIDGE OF PARTICULATE AND GROUND SUBSTANCES

FIELD OF THE INVENTION

This invention relates to an improved method for breaking a bridge of particulate and ground substances in a storage vessel by reducing the internal pressure in the storage vessel to enhance the effect of the break developed in the substances bridge and of fumigation in the storage vessel.

DESCRIPTION OF PRIOR ART

A big problem encountered in the conventional method is the formation of a bridge of particulate and ground substances that often takes place in discharging substances in powder (including particulate form) from the storage vessel. Unless this bridge is broken, the substances above the bridge cannot be discharged. Conventionally, the bridge formed in a storage vessel such as a silo has been broken by an operator who enters the vessel using a life-line and repeatedly thrusts a rod into the bridge or applies vibrations to the same, but safety and reliability of either method has been so low that, in the extreme case, the operator is caught under the bridge being broken and loses his life. Consequently, the fact is that no conventional method can achieve safe and assured breaking of such a bridge.

Recently, some methods using air under pressure as high as 700 kg/cm$^2$ for breaking of a bridge have been developed (e.g., Japanese Patent Public Disclosure No. 46646/1977). However, these require expensive apparatus and bring about environmental pollution by the dust exhausted together with the pressurized gas from the storage vessel.

What is more, any matter sticking to the internal walls of the vessel after discharging the powder substances from said vessel must be removed before storing more particulate and ground substances, and a method that can effect this removal easily has been desired.

According to a conventional method of fumigating bulk food and feed with a fumigant gas, the gas is absorbed only topically on the substances thus failing to achieve uniform fumigation of the grain. Therefore, in spite of convenience in transporting and storing food and feed in bulk, it has been difficult to fumigate such substances in bulk state.

SUMMARY OF THE INVENTION

It is an object of the invention, therefore, to provide a method for storing particulate and ground substances in a storage vessel and discharging the same therefrom that is safe for the operator, reduces the formation of bridges and assures breakage of any bridges formed, and which enables removal of the matter sticking to the walls of the emptied storage vessel as required.

Another object of the invention is to provide a method for uniform fumigating of particulate and ground food and feed (flour, meal, etc.), in bulk state with fumigant gas while avoiding local adsorption of gas and minimizing the gaseous residue.

Other objects and advantages of the present invention may become apparent to those skilled in the art from the following description and disclosure.

DESCRIPTION OF THE PREFERRED EMBODIMENT

Figure 1:
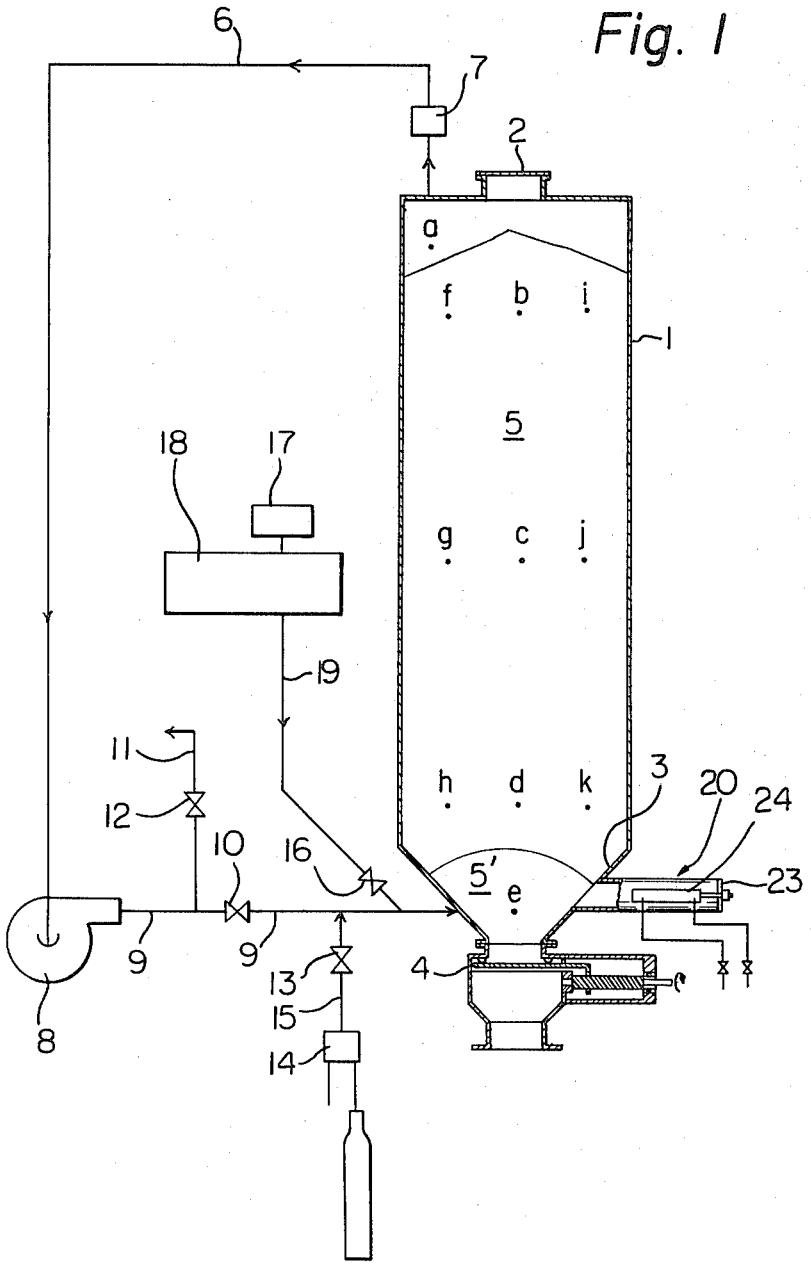
FIG. 1 illustrates one embodiment of this invention as it is applied to a silo.

According to this invention, a vessel for storing particulate and ground food, feed and inorganic substances, such as soybean meal, corn meal, flour, cement and the like is closed and placed under reduced pressure as low as below −100 mmHg, i.g., below 660 mmHg absolute, as the particulate and ground substances are being stored or after it has been discharged. Thereafter, by introducing atmosphere or inert gas under pressure as high as up to 10 kg/cm$^2$, impact is given to the substances stored in the pressure vessel, formation of bridges is made less likely, any bridge formed is broken and after discharge of the substances, any matter sticking to the internal walls of the vessel is removed. The bridge formed can be broken by a cycle of reduction of pressure and application of the impact or repeating this cycle a plurality of times after a certain period of storage. The formation of a bridge can be prevented in the same manner. After discharge of the particulate and ground substances from the storage vessel, the matter sticking to the internal walls of the vessel can be removed by reducing pressure and giving impact by introducing atmosphere or pressurized gas and through fluid contact with air or the like.

The pressure in the storage vessel may be reduced to as low as below −100 mmHg, preferably to from −400 mmHg to −740 mmHg and more preferably to from −650 mmHg to −720 mmHg, i.e., the pressure designated in terms of absolute pressure may be reduced to as low as below 660 mmHg absolute, preferably to from 360 mmHg absolute to 20 mmHg absolute, and more preferably to from 110 mmHg absolute to 40 mmHg absolute. If it is above −100 mmHg, i.e., above 660 mmHg, the impact to be imparted to the inside of the vessel after reduction of internal pressure will be too much.

The inert gas introduced into the storage vessel may be from atmosphere to up to 10 kg/cm$^2$, and preferably up to 3 kg/cm$^2$ pressure. If it is above 10 kg/cm$^2$, the apparatus will become expensive.

For the purpose of this invention, the site where atmosphere or pressurized gas is introduced for generating the impact is preferably the lower part of the storage vessel especially, near the hopper. The side where air is sucked out for reducing pressure is preferably the upper part of the vessel.

Regarding fumigation of particulate and ground food and feed according to this invention, a pressure resistant closed vessel such as silo or a transport container is filled with said substance, the pressure of the vessel is reduced to as low as below −100 mmHg, i.e., below 660 mmHg absolute, by using a vacuum pump, and if a bridge of said substances is present, it is broken as mentioned above by the impact of atmosphere or pressurized inert gas stored in a pressure vessel or the like that is introduced to obtain normal pressure, and thereafter the pressure is again reduced to as low as below −100 mmHg, i.e. below 660 mmHg, preferably to from −600 mmHg to −750 mmHg, i.e., from 160 mmHg to 10 mmHg absolute and more preferably to from −700 mmHg to −720 mmHg, i.e., from 60 mmHg to 40 mmHg absolute. If it is above −100 mmHg (660 mmHg absolute), it becomes difficult to effect uniform diffusion of the fumigant gas in the storage vessel. Vaporized fumigant gas, normally methyl bromide, in an amount of 10 to 100 g/m$^3$ of the internal volume of the vessel is added to the atmosphere under reduced pressure. The vessel is then filled with an inert gas such as nitrogen or carbon dioxide gas to bring the pressure of the closed vessel to normal pressure. The mixture of the fumigant gas and inert gas is circulated throughout the vessel by using a blower to thereby contact the gas mixture uniformly with the particulate and ground food and feed. If the concentration of the fumigant gas is less than 10 g/m$^3$, sufficient fumigation effect will not be obtained. On the other hand, if the concentration of the fumigant gas is greater than 100 g/m$^3$, the amount of gaseous residue on the grain will be too much.

One embodiment of this invention in which a silo for storing particulate and ground substances is the storage vessel is now illustrated by reference to the attached drawings. In FIG. 1, the vessel (1) is provided in its top with a port (2) through which the substances are to be charged and on the bottom with a hopper (3), under which are disposed a gate (4) capable of providing hermetic closure. The vessel (1) is filled with the substances in the conventional manner by using a transport mechanism not shown. A suction pipe (6) is disposed from above the vessel (1) by way of a filter (7), and this pipe is directly connected to a vacuum pump (8). From the vacuum pump (8) extends a supply pipe (9) directly connected to the hopper (3) by way of a valve (10). On the way to the valve (10), the supply pipe (9) is connected with an exhaust pipe (11) that can exhaust the air from the vessel through a valve (12) by closing the valve (10). The supply pipe (9) between the valve (10) and the hopper (3) is connected through a valve (13) with piping (15) extending from an apparatus for supplying a fumigant gas, for example, a vaporizer (14) for methyl bromide as well as connected through a valve (16) with a pressurized gas supplying pipe (19) extending from a tank (18) for supplying the inert gas pressurized by a compressor (17). The pressurized inert gas supplying pipe (19) can also be connected to an air introducing valve which will be described hereinafter or the hopper (3).

Figure 2:
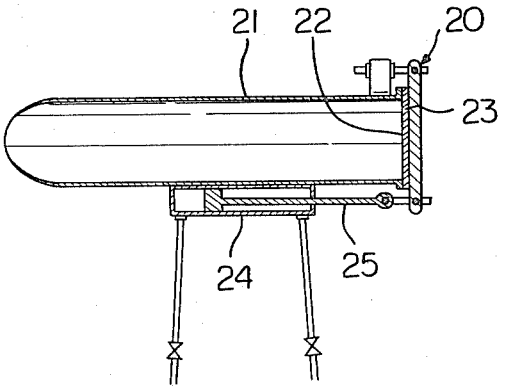
FIG. 2 is a cross section of the air introducing valve.

An air introducing valve (20) is provided on the hopper (3) for rapidly introducing air into the storage vessel (1) after reduction of its internal pressure. In the embodiment shown in FIG. 2, one end of a tubular body (21) is fixed to the hopper (3) and the opening on the other end (22) is provided with a hermetic valve (23) which is hinged at one side thereof and can be opened or closed by using a piston rod (25) of an air cylinder (24) disposed on the lateral side of the tubular body (21) and connected to the bottom of said valve (23). Any other conventional valve means (not shown) such as a spherical valve or a slide valve can be used for keeping the storage vessel air-tight during reduction of the internal pressure and for introducing air into the vessel rapidly.

If fumigation by gas is required after filling the storage vessel (1) with the particulate and ground food and feed, the air inside the vessel (1) is exhausted through the exhaust pipe (11) by reducing the internal pressure of the vessel using the vacuum pump (8) while the valve (10) is closed, and thereafter, by supplying the fumigant gas through the supply apparatus (14) with the valves (10) and (16) closed, efficient fumigation of the substances can be achieved in the vessel (1) through uniform diffusion of said gas. If circulation of the fumigant gas is required, the vacuum pump (8) may be operated with the valve (10) opened while the valves (12), (13) and (16) closed. After fumigation or during storage without fumigation, if there is a possibility that a bridge (5) may be formed, the pressure inside the vessel (1) is reduced in the same manner as described above, and by operating the air cylinder (24) with the valves (10) and (13) closed, air can be introduced into the hopper (3) through the air introducing valve (20), or instead of using the air introducing valve (20), pressurized air may be released from the pressure tank (18) into the hopper (3) by opening the valve (16) so as to apply the impact of the released gas to the bridge (5). One reason for bridge formation is high moisture and as a result of this impact and removal of moisture from the substances at the time of reduction of pressure, the formation of a bridge can be inhibited or an already formed bridge can be broken. Prior to the reduction of pressure for effective breaking of the bridge, it i preferred to open the gate (4) and discharge part of the grain (5') located below the bridge, and then close the gate (4) and reduce the pressure. By so doing the impact produced can be directly applied to the bridge.

In order to remove the matter sticking to the internal walls of the vessel left after discharge of the grain (5) from the vessel, the pressure of the air-tight vessel (1) is likewise reduced and the impact of the introduced air or pressurized air is applied to the inside of the vessel, with the result that said matter is removed from the internal walls of the vessel due to the impact as well as the fluid contact with the introduced normal air or pressurized air.

It has been discovered that reducing the pressure in the storage vessel brings a number of unexpected advantages. It enhances the effect of the break developed in the bridge and uniform fumigation in the storage vessel is obtained while avoiding local adsorption of gas and minimizing the gaseous residue; less pressure is required for breaking a bridge; there is less dust in the exhaust gas; further, less air is required for breaking a bridge because the amount of air required is equal to the amount removed from the storage vessel to bring the pressure of the vessel to normal pressure; the storage vessel need not be so strong because less air pressure is required for breaking a bridge; a smaller air introducing pipe is required because of the smaller amount of air breaking required or the pressurized air storage tank can be less strong and of smaller volume because of lower pressure and a smaller amount of air; air compressor can be of smaller capacity and lower power; there is less localized blowing through the substances and there is less breaking of particles because substances are more slowly forced into the fluidized state; compared with conventional breaking methods using high pressure without reduced pressure in the storage vessel.

The following Examples are given to further illustrate this invention, but it should be understood that the invention is by no means limited thereto. On the contrary, they are given only to clarify some of the essential working modes of the present invention.

EXAMPLE I

Advantages of the effect of the break developed in the bridge obtained with the present invention are demonstrated by the following comparative experiments:

A cylindrical silo (2.0 m in diameter, 17.12 m in height, and 52 $m^3$ of internal volume) made of steel plates was filled with 30 tons of soybean meal (specific gravity: 0.55) and closed. Said soybean meal was stored for a period of 16 days between June 14 and 30 and a bridge of soybean mean was formed. The part of the soybean meal located below the bridge was discharged, followed by closure and reduction of the pressure of the silo to −650 mmHg, i.e., to 110 mmHg absolute with a vacuum pump. The pressure of air to be applied to the lower portion of the silo for breaking of the bridge was about 3 $kg/cm^2$. On the other hand, without the reduction of the pressure of the silo, the breaking pressure of the bridge under the same conditions above was required about 6 $kg/cm^2$.

Figure 3:
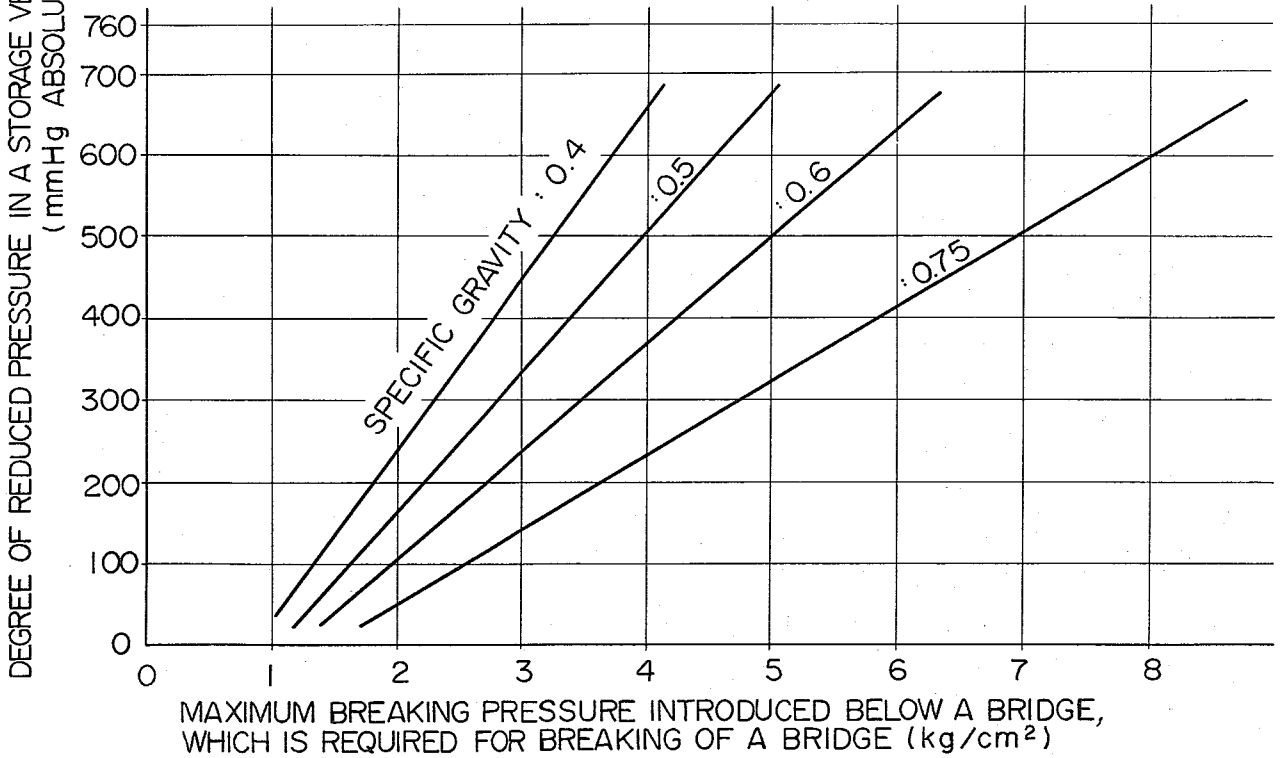
FIG. 3 is a line graph of relation between degree of reduced pressure in a storage vessel and breaking pressure at the lower portion of the vessel which is required for breaking of a bridge.

Using the cylindrical silo above, when specific gravity of substances varies from 0.4 to 0.75, the relation between degree of reduced pressure in a storage vessel and breaking pressure at the lower portion of the vessel which is required for breaking a bridge formed during 16 days storing was tested. The results obtained are shown in FIG. 3.

EXAMPLE II

Using a small-scale silo as illustrated in FIG. 1, a silo having a capacity of 3.46 $m^3$ was filled with 2,000 kg of soybean meal. Methyl bromide gas was fed into the silo and permeation of the gas through the meal was tested. The results are shown in the following Table 1.

TABLE 1

| Site of measurement | Test | A | | | | B | | |
|---|---|---|---|---|---|---|---|---|
| a | | 1.00 | 4.00 | 4.60 | 1.65 | 0.25 | 3.80 | 0.75 |
| b | | 1.40 | 4.00 | 4.45 | 1.85 | 1.80 | 3.25 | 0.35 |
| c | | 4.30 | 4.00 | 4.60 | 1.75 | 0.80 | 2.45 | 3.60 |
| d | | 3.10 | 4.70 | 4.60 | 16.00 | 6.50 | 9.20 | 1.15 |
| e | | 2.00 | 4.00 | 4.00 | 3.30 | 1.85 | 2.30 | 0.40 |
| f | | 2.00 | 4.75 | 4.00 | 0.95 | 0.85 | 2.00 | 0.10 |
| g | | 2.00 | 4.80 | 4.00 | 0.80 | 0.85 | 1.70 | 3.50 |
| h | | 2.00 | 4.85 | 4.00 | 22.75 | 9.50 | 11.50 | 1.10 |
| i | | 2.00 | 4.80 | 4.00 | 8.75 | 5.80 | 6.00 | 1.10 |
| j | | 2.00 | 4.75 | 4.00 | 6.00 | 6.00 | 5.15 | 1.00 |
| k | | 2.00 | 4.65 | 4.00 | 9.40 | 8.00 | 10.00 | 3.25 |
| Time after injection of gas | | 5 mins. | 10 mins. | 15 mins. | 10 mins. | 30 mins. | 50 mins. | 16 hrs. |

Note: In Test A, after the silo was filled with the soybean meal, its pressure was reduced from the atmospheric pressure to −700 mmHg, i.e., to 60 mmHg absolute, and charged with methyl bromide gas of 38.5 $g/m^3$ to obtain atmospheric pressure, and the concentrations of the gas ($g/m^3$) at different sites a through k were measured with a gas concentration meter ("Rilen 18 Model" manufactured by Riken Keiki Fine Instrument Co., Ltd.) using small pipes drawn from the respective sites. In Test B, the measurement of the gas concentration was effected without reducing the pressure in the silo filled with the soybean meal. A higher concentration 65 $g/m^3$ of the methyl bromide gas was used in Test B.

The Table 1 shows that in Test A where the pressure of the silo was reduced according to this invention, substantially the same concentration was obtained at each site 10 minutes after the injection, whereas in the Test according to the conventional method, uniform permeation of the gas was not obtained. It may be noted from the Table 1 that the figures obtained 15 minutes after injection were smaller than those obtained 10 minutes after injection on the average; this because the grain absorbed the gas, which means that due to deficiency of oxygen and permeation of the fumigant gas caused by liberation of air from within the meal as the pressure of the silo was being reduced not only the effect of fumigation against the vermin that live on the meal surface but against the vermin or theri eggs that live within the meal is increased.

After the fumigant gas was discharged from the silo and replaced by air, the meal was left to stand in the silo for 30 days. When the air-tight gate (4) was opened, a bridge as described by the imaginary line was formed. Thus, the air-tight gate was closed to reduce the internal pressure of the silo from the atmospheric pressure to −700 mmHg, i.e. to 60 mmHg absolute. When the air introducing valve (3) was opened, the bridge was broken by the impact of the atmospheric pressure applied thereto. By opening the air-tight gate again, the soybean meal could be taken out of the silo.

EXAMPLE III

A cylindrical silo made of steel plates (1.9 m in diameter, 21.7 m in height, and 52 $m^3$ of internal volume) was filled with 30 tons of soybean meal (specific gravity: 0.55) and closed. After reducing the pressure of the silo to −710 mmHg, i.e., to 50 mmHg absolute with a vacuum pump, the air introducing valve disposed on the hopper in the lower part of the silo was temporarily opened to introduce atmosphere, the impact of which was applied to the bridge from below to break it. The pressure of the silo was further reduced to −735 mmHg, followed by charging the silo with 2 kg of vaporized methyl bromide at the lower part thereof, while at the same time 28 $m^3$ of nitrogen gas was charged into the silo to bring the pressure of the silo to normal pressure.

For 50 minutes of the charging of the methyl bromide and nitrogen gas and for 15 minutes after charging of the same, the gas mixture was circulated by operating a blower at 0.3 $m^3$/min, and the silo was allowed to stand for 48 hours during which fumigation was accomplished.

After fumigation, the vacuum pump was used to reduce the internal pressure of the silo to −720 mmHg, i.e., to 40 mmHg absolute, and after allowing the silo to stand for a while, fresh air was introduced into the silo to bring its pressure to normal pressure.

The above procedure was repeated several times until no more methyl bromide was detected in the silo.

One cycle of reduction of pressure to restoration of normal pressure consisted of 35 minutes, and as a result of repeating this cycle 4 or 5 times, the content of methyl bromide gas as measured by a gas detector (Model 21 by Riken Keiki) was 0.

Control tests were made by repeating the above procedure except that air was used in place of nitrogen gas.

In the example and the control tests, 40 adult Rust-red flour beetle (*Tribolium castaneum HERBST*) were placed in each of the upper and lower layers of the meal to see the insecticidal effect of the fumigant gas. The following Table 2 shows the results of these experiments.

TABLE 2

| | Conc. of methyl bromide gas | | Insecticidal effect (%) | | Residual bromine in soybean meal (ppm) | |
|---|---|---|---|---|---|---|
| | Upper layer | Lower layer | Upper layer | Lower layer | Upper layer | Lower layer |
| Example III | 32.5 | 30.0 | 100 | 100 | 41.7 | 46.0 |
| Control test 1 | 0 | >100 | 0 | 100 | 0 | 613.7 |
| Control test 2 | 5.2 | 5.6 | 45 | 100 | 35.5 | 126.3 |

Note:

(1) In Control test 1, air was used in place of nitrogen gas, and methyl bromide was introduced at normal pressure without reduced pressure in the storage vessel.

(2) In Control test 2, the pressure was reduced to −710 mmHg to charging methyl bromide and air was used in place of nitrogen gas.

(3) Residual bromine was determined by the method recommended by FAO/WHO.

What is claimed is:

1. A method of breaking a bridge of particulate and ground substances in a storage vessel containing said substances, comprising the steps of closing said storage vessel containing gas and said substances, removing interior gas from the upper part of said vessel to reduce internal pressure of the vessel to between 360 and 20 mmHg absolute, and while the interior of said vessel is still at said reduced pressure directly impacting the substances forming said bridge from below with inert gas, without the intermediary of a liner between said bridge substances and said inert gas, by suddenly introducing said inert gas under a pressure of between atmospheric and 10 kg/cm$^2$ into said vessel below the bridge to break said bridge by said direct impacting.

2. The method of claim 1, wherein the internal pressure of the vessel is reduced to from 110 mmHg absolute to 40 mmHg absolute.

3. The method of claim 1, or 2, wherein the pressure of the pressurized inert gas is up to 3 kg/cm$^2$.

4. The method of claim 1, wherein application of the method for breaking the bridge is repeated a plurality of times.

5. The method of claim 1 or 4 in which, after discharge of the particulate and ground substances from the storage vessel by breaking the bridge thereof, particulate and ground substances sticking to the internal walls of the vessel is removed by again reducing pressure to between 360 and 20 mmHg absolute and providing impact by introducing inert gas under pressure of from atmospheric up to 10 kg/cm$^2$.

6. A method of breaking a bridge of particulate and ground substances in a storage vessel and for fumigating the same, comprising the steps of closing said storage vessel filled with gas and said substances, removing interior gas from the upper part of the vessel to reduce the internal pressure of the vessel to between 360 mmHg absolute and 20 mmHg absolute, directly impacting the substances forming said bridge from below with inert gas, without the intermediary of a liner between said bridge substances and said inert gas, by suddenly introducing inert gas under pressure of between atmospheric and 10 kg/cm$^2$ into said vessel below the bridge while the vessel is maintained at reduced pressure to break said bridge by said direct impacting, then removing the interior gas from the upper portion of said vessel to reduce the internal pressure of the vessel to between 160 mmHg absolute and 10 mmHg aboslute, and while the interior of said vessel is still maintained at reduced pressure, introducing fumigant gas into the interior of said vessel containing said substances, to bring its internal pressure to normal pressure and fumigate said substances.

7. The method of claims 1 or 6 wherein said vessel is an agricultural product storage vertical silo.

8. The method of claim 6, wherein inert gas is introduced a second time following the introduction of fumigant gas and the mixture of said second inert gas and fumigant gas brings the internal pressure of the storage vessel to normal pressure for effecting fumigation of the substances.

9. The method of claim 6, wherein the internal pressure of the vessel is reduced to from 110 mmHg absolute to 40 mmHg absolute for breaking the bridge.

10. The method of claim 6 wherein application of impact of the inert gas to the bridge is repeated a plurality of times.

11. The method of claim 6, wherein the internal pressure of the vessel is reduced to from 60 mmHg absolute to 40 mmHg absolute for fumigation.

12. The method of claim 9, wherein the mixture of the fumigant gas and the second inert gas is circulated throughout the vessel filled with the substances through a suction pipe.

13. The method of anyone of claims 6, 8, 12 and 9, wherein the pressure of the pressurized gas is up to 3 kg/cm$^2$ for breaking the bridge.

* * * * *

UNITED STATES PATENT AND TRADEMARK OFFICE

CERTIFICATE OF CORRECTION

PATENT NO. : 4,223,044

DATED : September 16, 1980

INVENTOR(S) : TSUNEYUKI SE et al

It is certified that error appears in the above—identified patent and that said Letters Patent is hereby corrected as shown below:

Title page, first column, after "Assignees":
after "Marubeni Corporation," replace "Higashi" with ---Osaka---.

Column 2, line 55: replace "side" with ---site---.

Column 4, line 26: after "it", replace "i" with ---is---.

Column 5, line 58: replace "(Rilen" with ---(Riken---.

Column 6, line 12: replace "theri" with ---their---.

Signed and Sealed this

*Twenty-fourth* Day of *February 1981*

[SEAL]

*Attest:*

RENE D. TEGTMEYER

*Attesting Officer*

*Acting Commissioner of Patents and Trademarks*